US006203182B1

(12) United States Patent
Hasegawa et al.

(10) Patent No.: US 6,203,182 B1
(45) Date of Patent: Mar. 20, 2001

(54) STRUCTURE OF WATER DRAIN IN VEHICLE LAMP

(75) Inventors: Toru Hasegawa; Shinichi Maeda, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/253,004

(22) Filed: Feb. 19, 1999

(30) Foreign Application Priority Data

Feb. 23, 1998 (JP) ..... 10-040562

(51) Int. Cl.[7] ..... F21V 29/00

(52) U.S. Cl. ..... 362/547; 362/473; 362/373; 362/294

(58) Field of Search ..... 362/547, 373, 362/294, 473

(56) References Cited

U.S. PATENT DOCUMENTS 4,658,339 * 4/1987 Tammerijn ..... 362/294
4,733,335 * 3/1988 Serizawa et al. ..... 362/373
4,739,458 * 4/1988 Yamayoshi ..... 362/294
5,072,339 * 12/1991 Shimojo ..... 362/473
5,406,467 * 4/1995 Hashemi ..... 362/294
5,457,616 * 10/1995 Grigorescu et al. ..... 362/294
5,702,178 * 12/1997 Smith et al. ..... 362/294

FOREIGN PATENT DOCUMENTS 9-183391 7/1997 (JP) .

* cited by examiner

*Primary Examiner*—Thomas M. Sember
(74) *Attorney, Agent, or Firm*—Birch, Stewart, Kolasch & Birch, LLP

(57) ABSTRACT

A water drain includes an outer opening formed on a flange of a lamp body, a recess formed on a flange of a lens, a path formed between the flanges, and a slope rising toward the lens and the lamp body. Water splashed by a front wheel of a motorcycle is downwardly reflected by the slope on the lens, thereby reducing the amount of water entering via the outer opening. Furthermore, the outer opening is tapered toward its inner side which makes it difficult for water to pass therethrough. Still further, front and rear indicators can be realized using common components.

13 Claims, 10 Drawing Sheets

STRUCTURE OF WATER DRAIN IN VEHICLE LAMP

BACKGROUND OF THE INVENTION

1. Field of the Invention

The present invention relates to a structure for water drainage in a vehicle lamp.

2. Description of Related Art

Japanese Patent Laid-open No. Hei 9-18391, entitled "Lamp for Motorcycle", exemplifies a water drain hole 20 as shown in FIG. 3 of that publication. The water drain hole 20 serves to discharge water and disperse air heated by a bulb in the vehicle lamp. Referring to FIG. 3, an arrow between the outer opening 26 and the inner opening 28 denotes water that may enter into the vehicle lamp when the vehicle is being cleaned or the like. However, this later cannot enter beyond the barrier 18.

In the accompanying drawings, the terms "front" and "rear" denote the directions as seen by a rider on a motorcycle.

FIG. 14 is a side view of a typical motorcycle 100. The motorcycle 100 comprises a body frame 101, a front fork 102, a front wheel 103, a head lamp 104, front indicators 105, 105 (the lamp 105 on the opposite side is not shown), a meter 106, a steering handle 107, a swing arm 111, a rear wheel 112, a tail/stop lamp 113, and a pair of rear indicators 114, 114 (the lamp 114 on the opposite side is not shown). The components 102, 103, 104, 105, 106 and 107 are positioned at the front part of the body frame 101, while the components 111, 112, 113 and 114 are positioned at the rear part of the body frame 101. In FIG. 14, reference numerals 116, 117 and 118 denote an engine, a fuel tank and a rider's seat, respectively.

In case of rain, the rear wheel 112 may splash water as shown by arrows ① and ②. Furthermore, some of the water splashed by the front wheel 103 may strike the rear indicators 114 as shown by an arrow ③.

FIG. 15 is a cross sectional view of the main part of a conventional front indicator, specifically showing the bottom part of the front indicator 105. The water drain hole structure 120 of the front indicator 105 is similar to that of the foregoing laid-open publication. Therefore, water entering via the outer opening 121 can be effectively blocked by the blockade 122. This structure is effective in protecting the front indicators against water, shown by an arrow ④, splashed from the front side of the moving motorcycle.

FIG. 16 is a cross sectional view of a main part of the rear indicator 114, specifically showing the bottom part thereof. The rear indicator 114 is the same as the front indicator 105, and is oriented exactly opposite to the front indicator 105, i.e. it is turned by 180° on a vertical axis. The same components are used as the front and rear indicators in order to reduce the number of components.

Water splashed by the front wheel (see FIG. 14) enters into the rear indicator 114 via the outer opening 131 of the water drain structure 130, is reversed by the upright wall 132, and reaches the barrier 133. In the event of rain, water tends to go beyond the barrier 133 and enter into the rear indicator 114.

Since a motorcycle usually takes a short period of time to clean, only a little water splashes into the motorcycle, allowing for effective drainage. Therefore, there is no serious problem in such a case. However, on a rainy day, the motorcycle is exposed to rain for a long period of time. Therefore, water tends to enter into the motorcycle more substantially. Hence, there has been a strong demand for improved water drainage structures in motorcycles.

SUMMARY OF THE PRESENT INVENTION

The present invention is therefore intended to provide vehicle lamps that include improved water resistance and that can be used in common among different motorcycles.

According to a first aspect of the present invention, a water drain structure is applied to a vehicle lamp having a lens attached to a lamp body housing, a bulb therein, and a water drain provided at least at a lower part of either the lamp body or the lens. This structure is characterized in that the water drain is a tapered path formed in the lamp body or the lens. Furthermore, the water drain is wide at a bottom thereof and narrowed towards a top thereof.

The slope formed on the surface of the lamp body or the lens downwardly reflects water splashed by the front wheel. Furthermore, the upwardly tapered water drain can effectively block entering water.

According to a second aspect of the present invention, the water drain comprises a first path extending downward from the vehicle lamp, a second path laterally extending from the bottom of the first path toward a front surface of the lens, and a tapered path communicating with an outlet of the second path.

Water splashed by the front wheel is reflected downward by the slope so that only a little water is laterally splashed. This can reduce the amount of water entering into the second path which is flat.

According to a third aspect of the present invention, either the lamp body or the lens has a recess cut therein.

The outer opening can be easily cut into the lamp body or the lens. Lamp bodies and lenses can be easily ejection-molded using existing molds to which some modifications are made. The lamp bodies and lenses can therefore be manufactured at a reduced cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
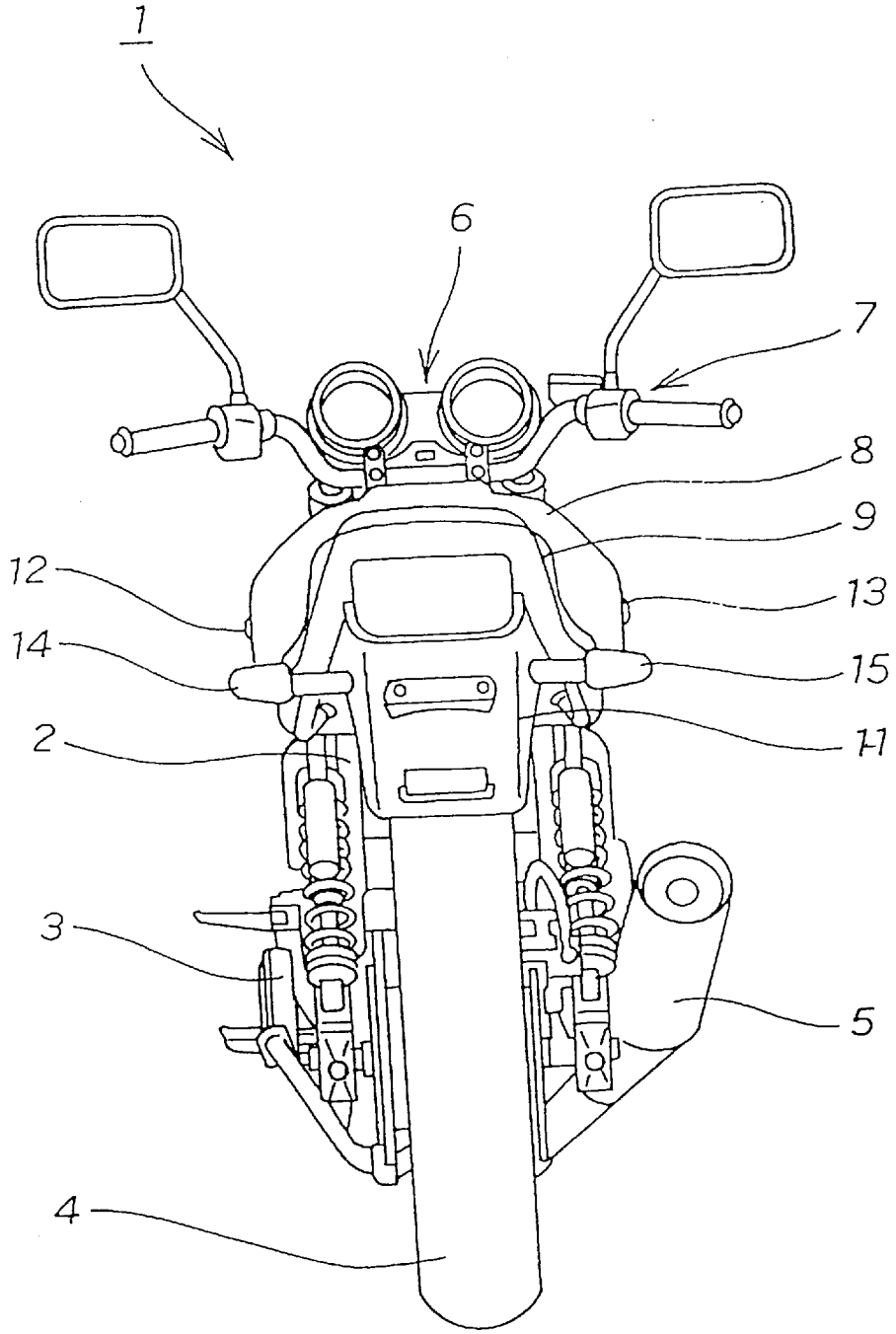
FIG. 1 is a top view of a motorcycle of the present invention.

The present invention will now be described with reference to the accompanying drawings. FIG. 1 is a top view of a motorcycle 1 to which the invention is applicable. The motorcycle 1 comprises a frame 2, an engine 3, a rear wheel 4 driven by the engine 3, a muffler 5, a meter 6, a steering handle 7, a fuel tank 8, a seat 9, and a rear fender 11. The components 6, 7, 8 and 9 are arranged in the named order at the front part of the body frame 2. Reference numeral 12 denotes a left front indicator positioned on an underside of the steering handle 7, reference numeral 13 is a right front indicator, and 14 and 15 are left and right rear indicators attached on the rear fender 11.

The left front indicator 12 is the same as the right rear indicator 15, and the right front indicator 13 is the same as the left rear indicator 14, which is effective in using components in common. In this specification, the terms "left, right, front and rear" denote directions viewed by the rider on the motorcycle.

Figure 2:
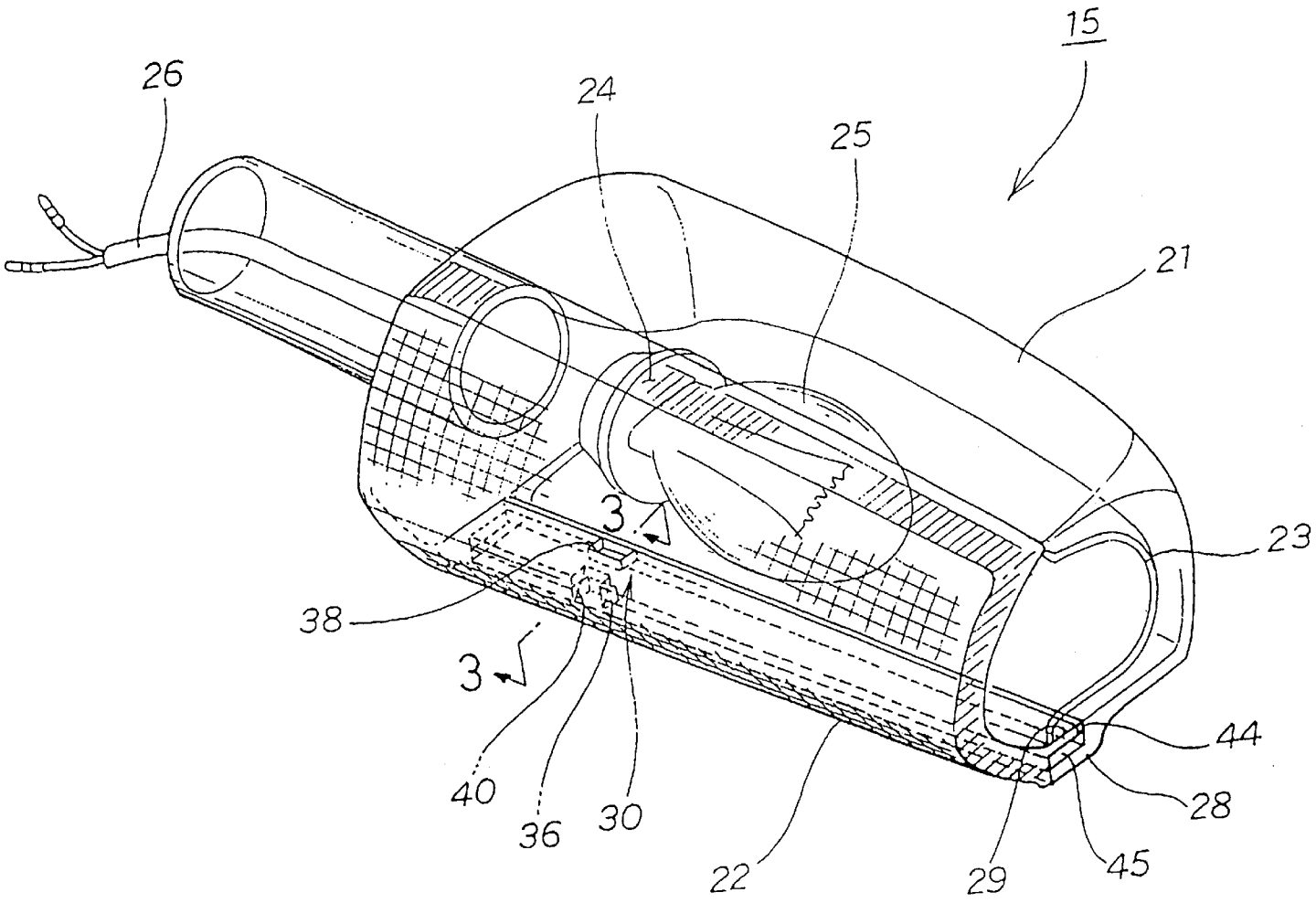
FIG. 2 is a perspective view of a rear indicator of the present invention.

FIG. 2 is a perspective view of the right rear indicator 15. The right rear indicator 15 includes a lamp body 21, a lens 22 fitted into an opening of the lamp body 21, a reflector 23 attached to the lens 22 for reflecting light, a bulb 25 attached to the reflector 23 via a socket 24, a cable 26 connected to the bulb 25 in order to conduct electricity to the bulb 26, and a water drain 30 formed on the bottom of the lens 22.

Reference numeral 28 is a flange of the lamp body 21, and 29 denotes a flange of the lens 22.

Figure 3:
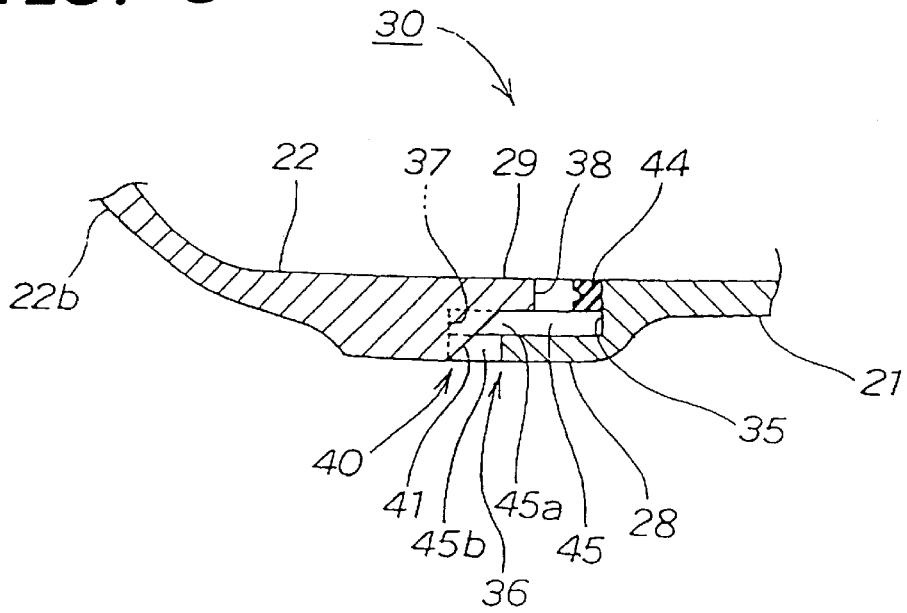
FIG. 3 is a cross sectional view, taken along line 3—3 in FIG. 2.
Figure 4:
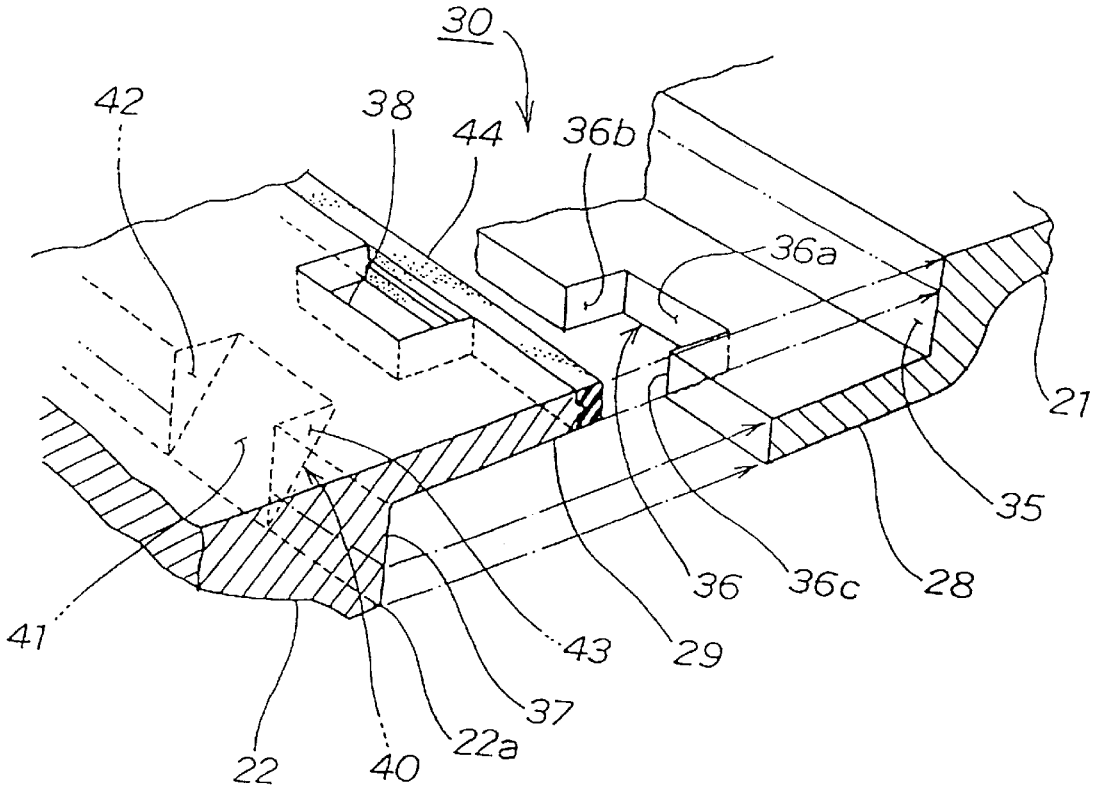
FIG. 4 is an exploded view showing the main part of a water drain for a vehicle lamp, according to the present invention.

FIG. 3 shows a cross section of the right rear indicator 15, taken along line 3—3 in FIG. 2. FIG. 4 is an exploded view of a part of the water drain for the vehicle lamp related to the present invention. FIG. 4 will be described first of all in order to facilitate understanding of the invention.

Referring to FIG. 4, a vertical seat surface 35 is formed at an open edge of the lamp body 21, and an outer opening 36 is formed on the flange 28 horizontally extending from the seat surface 35. The outer opening 36 has a cross section in the shape of an E-channel, and has a bottom 36*a* and two sides 36*b* and 36*c*.

A longitudinal wall 37 extends from an edge 22*a* of the lens 22. A recess 38 in the shape of an E-channel is formed on the flange 29 horizontally extending from the longitudinal wall 37. The recess 38 serves as a first path. A slope 40 is formed at a comer of the longitudinal wall 37, where the longitudinal wall 37 comes into contact with the flange 29.

The slope 40 includes a reflecting surface 41 that obliquely extends from the edge 22*a* of the lens 22 toward the lamp body 21. Sides 42 and 43 are present along the opposite sides of the reflecting surface 41. Reference numeral 44 denotes a sealer 44.

The lens 22 is fitted into the opening of the lamp body, as shown by phantom lines, with the sealer 44 sandwiched between the seat surface 35 and the flange 29, the longitudinal wall 37 brought into contact with the flange 28, and the slope 40 fitted into the outer opening 36, thereby forming a water drainage hole.

Referring to FIG. 3, the water drain 30 is constituted by the opening 36 formed on the lamp body 21, a second path 45 formed between the flanges 28 and 29, an outlet 45*a* of the second path 45, the recess 38 formed on the lens 22, and the slope 40. In other words, the water drain 30 starts from the recess 38, extends via the path 45 and terminates at the outer opening 36.

Specifically, the sealer 44 is attached to the lens 22. The sealer is then brought into pressure contact with the seat surface 35, thereby closing the opening of the lamp body 21. In this state, the outer surface of the lamp body 21 and the lens 22 are flush with each other. The water drain 30 includes the slope 40 with the reflecting surface 41 extending downward, thereby forming a path 45*b* tapered upward on the slope 40. Reference numeral 22*b* identifies an edge of the lens 22.

Figure 5:
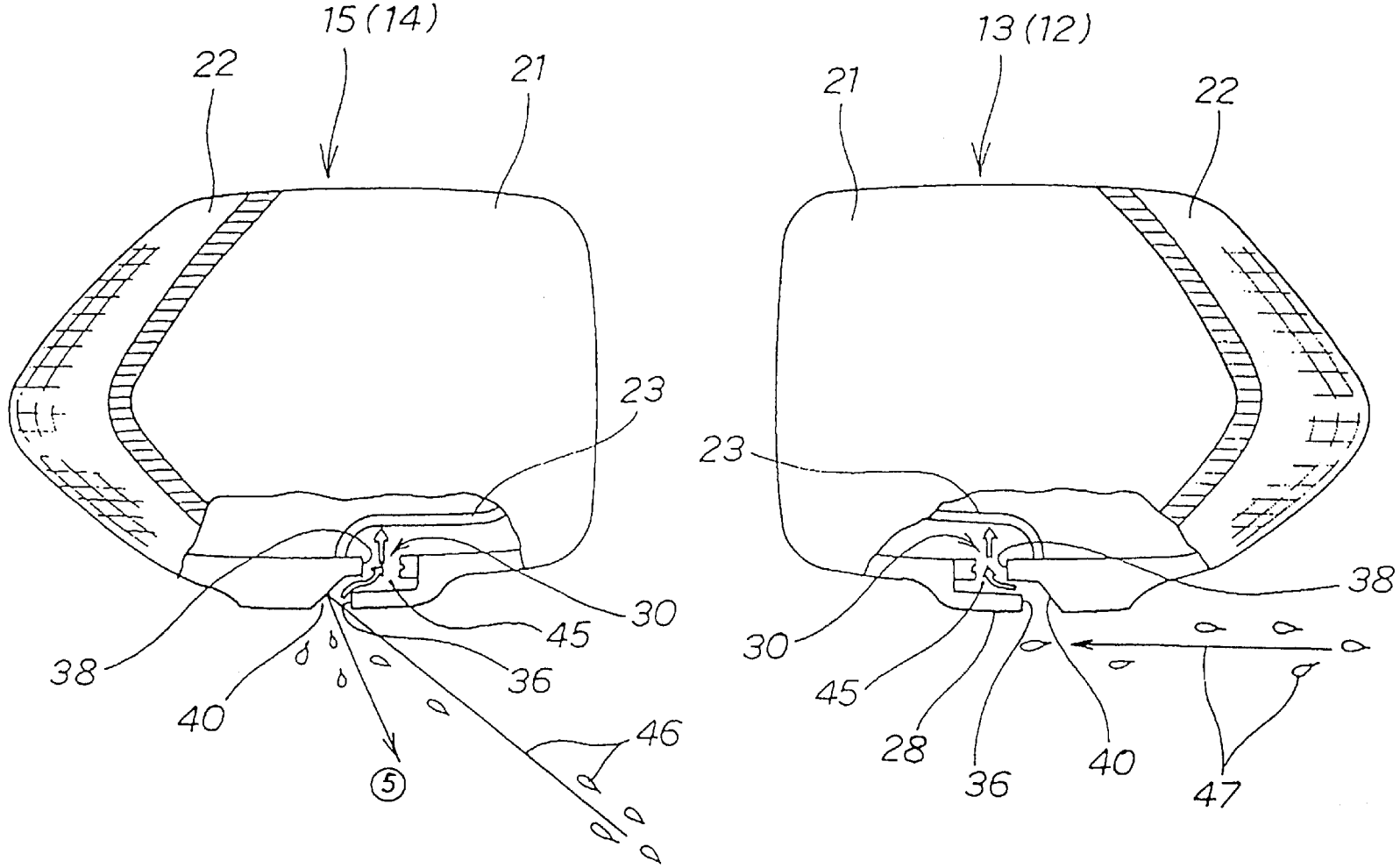
FIG. 5 shows the operation of the water drain for the vehicle lamp according to the present invention.

The operation of the water drain will be described hereinafter. FIG. 5 shows the operation of the water drain according to the present invention. With the right rear indicator 15, shown at the left side in FIG. 5, air enters into the water drain 30 via the outer opening 36, path 45 and recess 38 as shown by white arrows, and comes out of the water drain 30 in the reverse order. Air heated in the indicator 15 is cooled by air entering thereinto, i.e. air is expanded and compressed in the indicator 15.

It is assumed here that water enters into the tapered path 45 of the water drain 30 during cleaning or the like. In such a case, water flows through the tapered path 45, gathers toward the outer opening 36, and is discharged therefrom. Therefore, no water remains in the tapered path 45.

When the motorcycle is running on a rainy day, some of the water 46 splashed by the front wheel occasionally reaches the water drain 30. The slope 40 reflects such water 45 downward as shown by an arrow ⑤, using its reflecting angle.

The water drain 30 is tapered upward by the slope 40, thereby making it difficult for water 46 to enter thereinto. As a result, only a small amount of water or rain drops is splashed or stuck onto the tapered path 45.

The left rear indicator 14 is structured similarly to the right rear indicator 15, and will not be further described.

The right front indicator 13 (shown at the right side in FIG. 5) is structured similarly to the left and right rear indicators 14 and 15. Further, air enters into and flows out of the front indicators similar to the rear indicators, and will not be further described.

In case of rain, a first motorcycle in front of a second motorcycle may splash water 47 onto the right front indicator 13 of the second motorcycle. Such water 47 coming in a flat state from a relatively distant point rarely enters into the lamp body via the water drain 30. Even if some of the water 47 advances toward the water drain 30, it flows rearward without coming into contact with the outer opening 36. This is because the lamp body 21 and the lens 22 are flush with each other. Therefore, it is difficult for water 47 to enter via the water drain 30.

Figure 6:
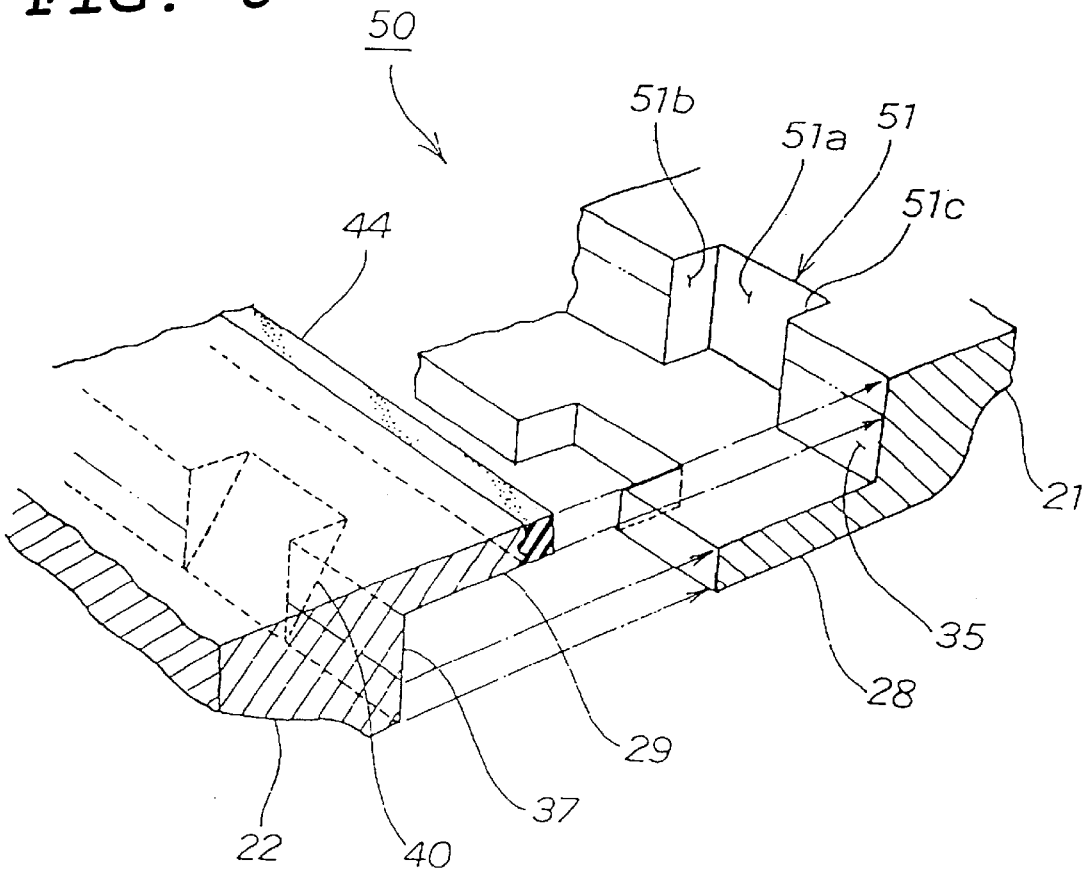
FIG. 6 is an exploded view of the main part of the water drain according to a second embodiment of the present invention.

FIG. 6 is an exploded view of a water drain structure according to a second embodiment of the present invention. The components identical to those in the first embodiment in FIGS. 2 to 4 will be assigned the identical reference numerals, and will not be further described.

A water drain 50 has an inner opening formed on the lamp body 21, similar to the first embodiment. Furthermore, a recess 51, as a first path, is formed on the lamp body 21. The recess 51 is in the shape of an E-channel, and includes a bottom 51*a* and two sides 51*b* and 51*c*.

Figure 7:
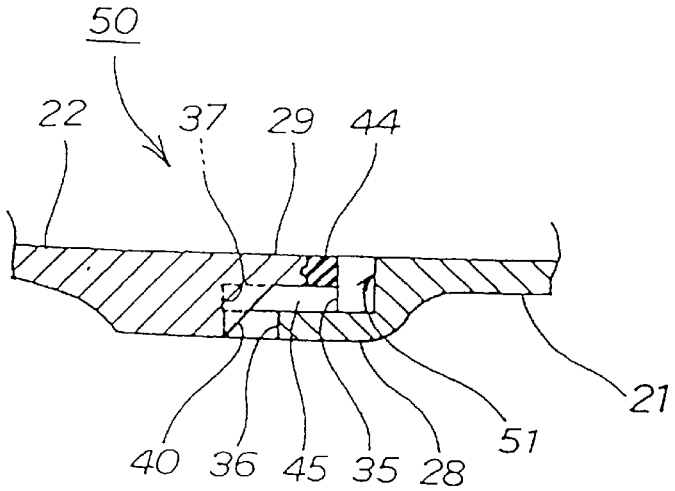
FIG. 7 shows a cross section of the main part of the water drain according to the second embodiment of the present invention.

FIG. 7 is a cross sectional view of the main part of the water drain 50 of the second embodiment. The water drain 50 is constituted by the recess 51 formed on the lamp body 21, path 45, outer opening 36 and slope 40. In other words, the water drain 50 starts from the recess 51, extends via the path 45, and terminates at the outer opening 36. The recess 51 is relatively far from the outer opening 36, so that it is relatively difficult for water to enter. Further, the lens without a recess is more rigid than in the first embodiment.

Figure 8:
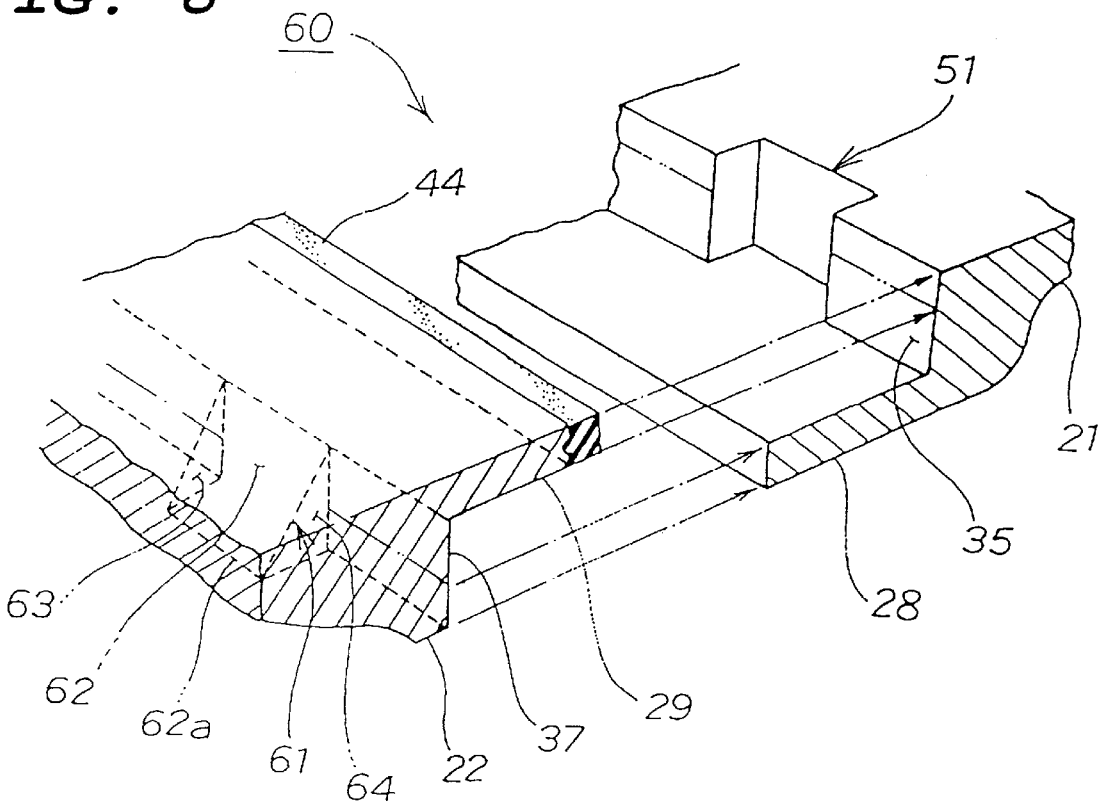
FIG. 8 is an exploded view of the main part of the water drain according to a third embodiment of the present invention.

The main part of a further water drain 60 according to a third embodiment of the present invention is shown by an exploded view in FIG. 8. Components identical to those in the embodiments in FIGS. 2 to 4 and FIGS. 6 and 7 will be assigned identical reference numerals, and will not be further described.

Similar to the first embodiment, the water drain 60 has an outer opening on the lens 22. Specifically, a slope 61 in the shape of a groove is formed on the lens 22. The slope 61 includes a groove-shaped reflecting surface 62 formed on the longitudinal wall 37, and sides 63 and 64.

The reflecting surface 62 rises obliquely toward the lamp body 21 from the outer opening 62*a* which is formed by cutting the lens 22 in the shape of an E-channel, extends to the flange 29, and slopes downward.

Figure 9:
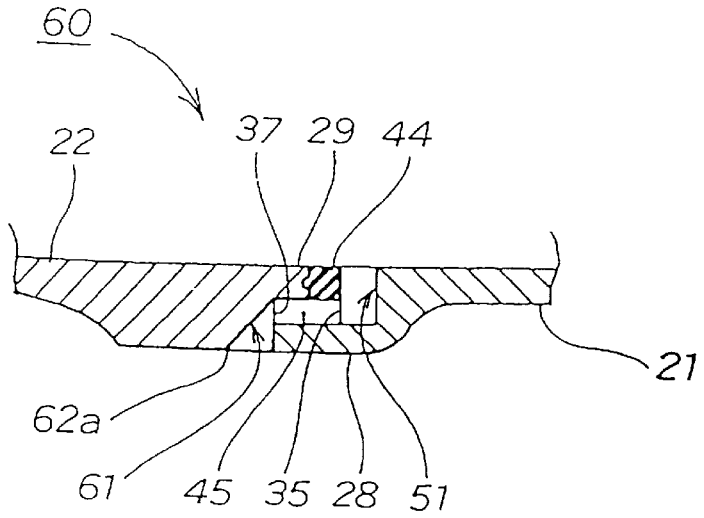
FIG. 9 shows a cross section of the main part of the water drain according to the third embodiment of the present invention.

FIG. 9 shows a cross section of the main part of the water drain 60 according to the third embodiment of the present invention, which is constituted by the recess 51 formed on the seat surface 35 of the lamp body 22, path 45, and slope 61 formed on the longitudinal wall 37 of the lens 22. In other words, the water drain 60 starts from the recess 51, extends via the path 45 and the slope 61, and terminates at its outer opening.

The water drain 60 can be realized simply by adding the slope 61 to an existing lens. The water drain 60 can be easily formed by simply modifying existing indicators at a few locations. It is therefore possible to reduce the time for redesigning and machining existing indicators. As a result, indicators having excellent waterproof characteristics can be realized at a reduced cost.

Figure 10:
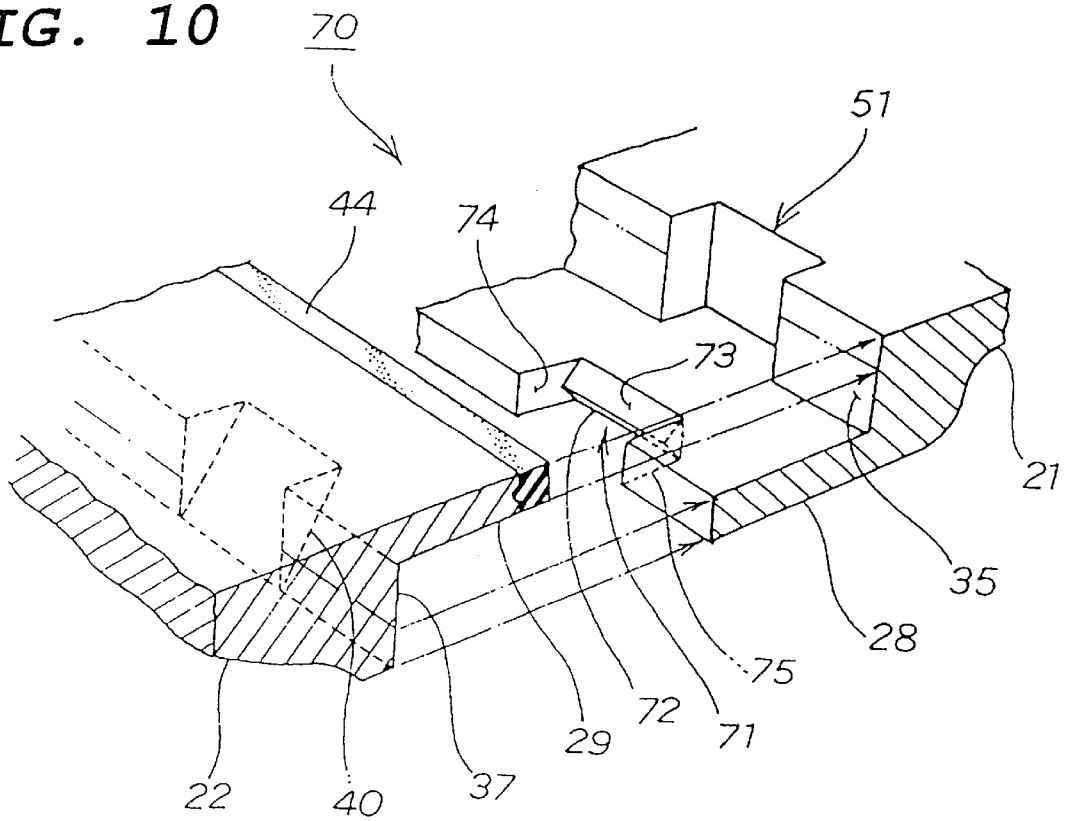
FIG. 10 is an exploded view of the main part of the water drain according to a fourth embodiment of the present invention.

The main part of a further water drain 70 according to a fourth embodiment of the present invention is shown by an exploded view in FIG. 10. Components identical to those in the embodiments shown in FIGS. 2 to 4 and FIGS. 6 and 7 are assigned identical reference numerals, and will not be further described.

The water drain 70 includes slopes on the lamp body 21 and the lens 22. A slope 71 is formed on the flange 28 of the lamp body 21. The slope 71 includes a first sloping portion 72, a second sloping portion 73, and two sides 74 and 75 extending from the sloping portions 72 and 73. The sloping portions 72 and 73 are formed by substantially halving the flange 28 along a thickness thereof.

Figure 11:
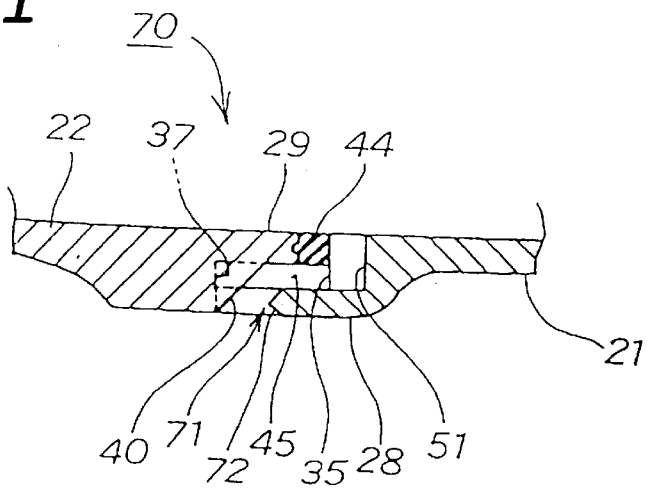
FIG. 11 shows a cross section of the main part of the water drain (according to the fourth embodiment).

FIG. 11 shows a cross section of the main part of the water drain 70 according to the fourth embodiment of the present invention. The water drain 70 is constituted by the recess 51, path 45, slope 71 formed on the flange 28 of the lamp body 21, and slope 40. The water drain 70 starts from the recess 51, extends via the path 45 and slope 71, and terminates at the outer opening thereof.

In case of rain, a first motorcycle in front of a second motorcycle may splash water onto the water drains 70 of the left and right front indicators 12 and 13 (shown in FIG. 1). Water reaching the slope 71 will be reflected downward by the first and second sloping portions 71 and 72, using the reflecting angles.

Further, water splashed onto the left and right rear indicators 14 and 15 (see FIG. 1) from the rear part of the motorcycle will be reflected downward by the first sloping portion 72, using the reflecting angle thereof. Therefore, the vehicle lamps can be protected against water splashed either from the front or rear part thereof.

Figure 12:
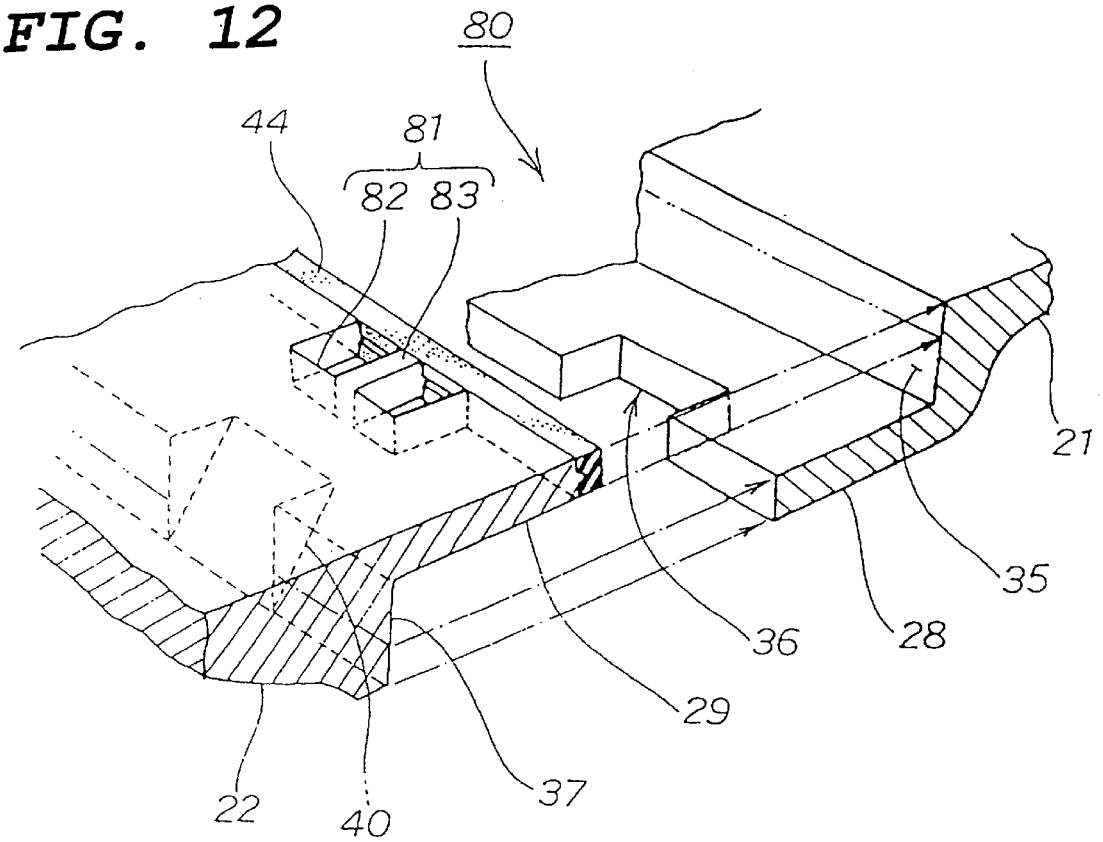
FIG. 12 is an exploded view of the main part of the water drain according to the fifth embodiment.

The main part of a further water drain 80 according to a fifth embodiment of the present invention is shown by an exploded view in FIG. 12. Components identical to those in the embodiments in FIGS. 2 to 4 will be assigned identical reference numerals, and will not be further described.

Similar to the water drain in the first embodiment, the water drain 80 includes an inner opening divided into two portions, i.e. a recess 81 is divided into two portions 82 by a divide 83, and is formed on the flange 29 of the lamp body 21.

The portions 82 are formed by dividing the recess 38 (shown in FIG. 4) with the divide 83. Each portion 82 has a small open area.

Figure 13:
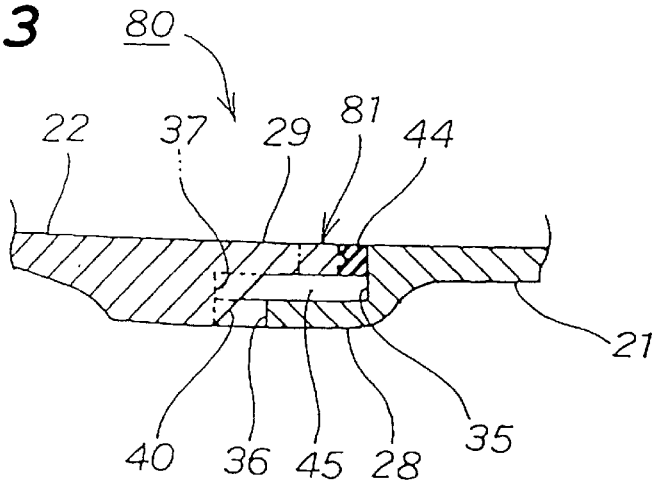
FIG. 13 shows a cross section of the main part of the water drain (according to the fifth embodiment).
Figure 14:
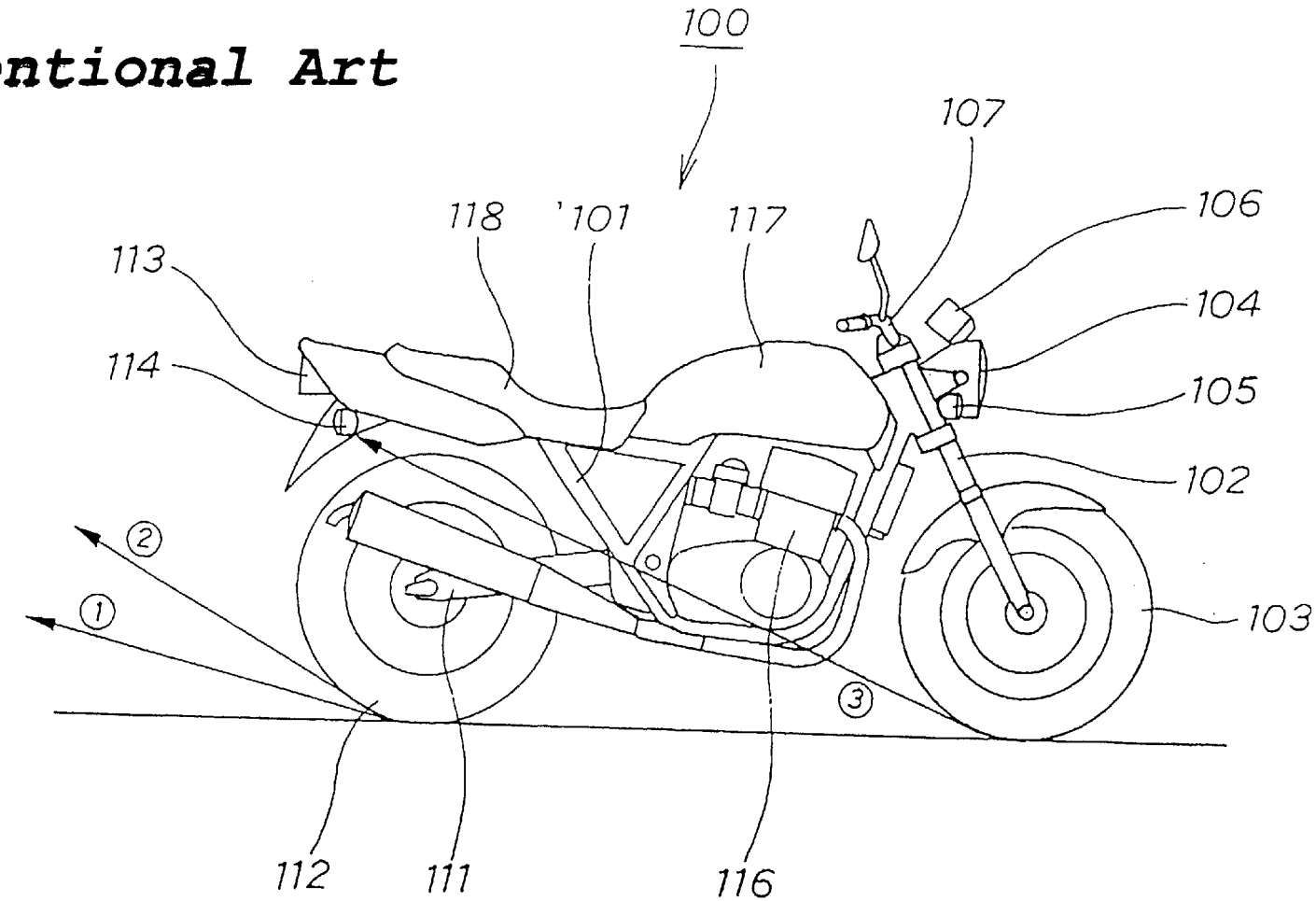
FIG. 14 Conventional Art
FIG. 14 is a side view of a typical motorcycle.
Figure 15:
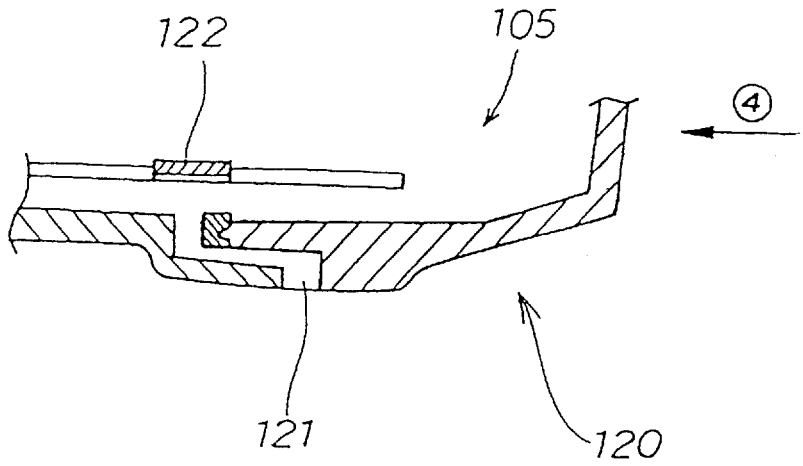
FIG. 15 Conventional Art
FIG. 15 is a cross sectional view showing the main part of a front indicator of the related art.
Figure 16:
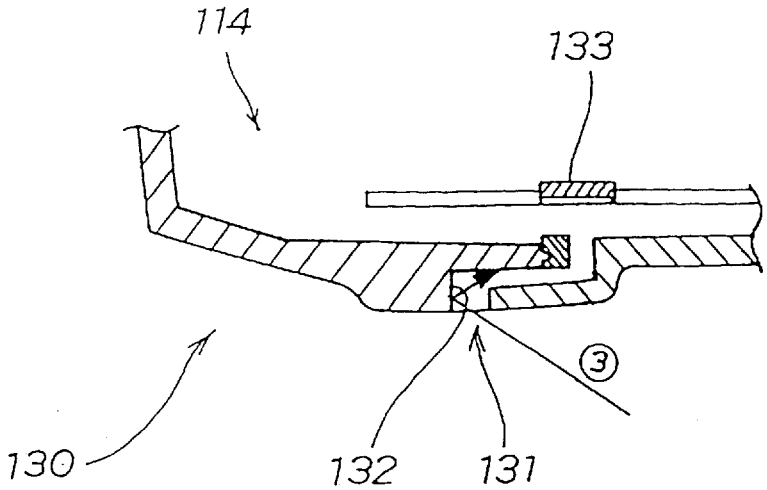
FIG. 16 Conventional Art
FIG. 16 is a cross sectional view showing the main part of a conventional rear indicator.

FIG. 13 shows a cross section of the main part of the water drain 80 according to the fifth embodiment of the present invention. The water drain 80 is constituted by the recess 81, path 45, outer opening 36 and slope 40. The water drain 80 starts from the recess 81, extends via path 45, and terminates at the outer opening 36.

The recess 81 is divided by the divide 83 (shown in FIG. 12). Each of the divided portions has a small open top. Air can easily pass therethrough while it is difficult for water drops to enter thereinto. Water entering into the path 45 cannot easily pass through the recess 81. Therefore, watertightness can be further improved.

Only the first slope 72 may be provided alone by omitting the second slope 73 shown in FIG. 11.

Further, the outer opening 36 and recess 38 do not have to be in the shape of an E-channel, but may have any shape so long as they can efficiently drain water.

The present invention is effective in the following respects.

According to a first aspect of the present invention, water splashed by the front wheel can be reflected downward by the slope extending upward from the edge of the outer opening toward the lamp body or the lens, so that it is possible to prevent water from entering into vehicle lamps via the outer openings of the water drains. Furthermore, since the lamp body is flush with the lens, it is difficult for water splashed by a first motorcycle in front a second motorcycle to enter into the front indicators through the outer openings. The same components are usable as front and rear indicators.

Furthermore, each outer opening is tapered toward its inner side in order to effectively prevent entry of water thereinto. Therefore, an amount of water entering into the vehicle lamp can be reduced at the outer opening of the water drain. Furthermore, the number of components required can be reduced.

According to a second aspect of the present invention, the slope of the tapered path downwardly reflects water splashed by the front wheel, so that only a little water may be laterally splashed. this reduces the amount of water entering into the second path that which is horizontal. Therefore, it is possible to reduce the amount of water entering into the vehicle lamps.

According to a third aspect of the present invention, the outer opening is formed at least either on the lamp body or lens. It is easy to form such an outer opening. The lamp body or lens can be easily injection-molded using existing molds to which some modifications are made. It is therefore possible to produce the lamp body or lens at a reduced cost.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A vehicle lamp comprising:

a lamp body for housing a bulb therein;

a lens attached to said lamp body; and a water drain located at a lower part of at least one of the lamp body and the lens, said water drain includes a tapered path with a slope formed in at least one of the lamp body and the lens, said tapered path is wide at a bottom portion thereof and is narrowed toward a top portion thereof; and wherein the lens has a recess cut therein, said recess including two recess portions separated by a divider portion.

2. The vehicle lamp according to claim 1, wherein the water drain further comprises:

a first path extending downward from an inside of the vehicle lamp;

a second path laterally extending from a bottom of said first path toward a front surface of the lens; and said tapered path communicates with an outlet of said second path.

3. The vehicle lamp according to claim 1, wherein at least one of the lamp body and the lens has an outer opening cut therein.

4. The vehicle lamp according to claim 1, wherein the tapered path is formed on the lens.

5. The vehicle lamp according to claim 4, wherein the slope is a groove formed in the lens.

6. The vehicle lamp according to claim 1, wherein the tapered path includes a slope in the lens and a slope in the lamp body, said slope in the lens is a single sloped surface, said slope in the lamp body includes first and second sloping surfaces.

7. A water drain for a vehicle lamp, said vehicle lamp including a lamp body for housing a bulb therein, a lens attached to the lamp body, and a water drain located at a lower part of at least one of the lamp body and the lens, said water drain comprising:

a tapered path with a slope formed on the lens, and said tapered path is wide at a bottom portion thereof and is narrowed toward a top portion thereof.

8. The water drain according to claim 7, wherein the water drain further comprises:

a first path extending downward from an inside of the vehicle lamp;

a second path laterally extending from a bottom of said first path toward a front surface of the lens; and said tapered path communicates with an outlet of said second path.

9. The water drain according to claim 7, wherein the water drain further comprises at least one of the lamp body and the lens having an outer opening cut therein.

10. The water drain according to claim 7, wherein the water drain further comprises at least one of the lamp body and the lens having a recess cut therein.

11. The water drain according to claim 10, wherein said recess is formed in the lens, said recess including two recess portions separated by a divider portion.

12. The water drain according to claim 7, wherein the slope is a groove formed in the lens.

13. The water drain according to claim 7, wherein the tapered path includes a slope in the lens and a slope in the lamp body, said slope in the lens is a single sloped surface, said slope in the lamp body includes first and second sloping surfaces.

* * * * *